US007808382B2

(12) United States Patent
Bonato

(10) Patent No.: US 7,808,382 B2
(45) Date of Patent: Oct. 5, 2010

(54) ANTI-THEFT DEVICE, PARTICULARLY FOR DISPLAYS THAT CAN BE PLACED IN POINTS OF SALE

(76) Inventor: Ferruccio Bonato, Via Monte Carega, 4/6, 37019 Peschiera Del Garda (IT)

( * ) Notice: Subject to any disclaimer, the term of this patent is extended or adjusted under 35 U.S.C. 154(b) by 547 days.

(21) Appl. No.: 11/662,265

(22) PCT Filed: Sep. 6, 2005

(86) PCT No.: PCT/EP2005/009568

§ 371 (c)(1),
(2), (4) Date: Mar. 9, 2007

(87) PCT Pub. No.: WO2006/029742

PCT Pub. Date: Mar. 23, 2006

(65) Prior Publication Data

US 2008/0129503 A1 Jun. 5, 2008

(30) Foreign Application Priority Data

Sep. 16, 2004 (IT) ..... VR04A0146

(51) Int. Cl.
*G08B 13/12* (2006.01)

(52) U.S. Cl. ..... 340/568.2; 340/568.4; 70/58

(58) Field of Classification Search ..... 340/568.2, 340/568.4, 568.8; 70/58
See application file for complete search history.

(56) References Cited

U.S. PATENT DOCUMENTS 5,072,213 A * 12/1991 Close ..... 340/568.2
5,146,205 A * 9/1992 Keifer et al. ..... 340/568.2
5,574,430 A * 11/1996 Ott et al. ..... 340/568.2
5,868,014 A 2/1999 Lee et al.
6,039,496 A 3/2000 Bishop et al.
6,380,855 B1 4/2002 Ott
6,462,668 B1 * 10/2002 Foseide ..... 340/687
6,476,717 B1 * 11/2002 Gross et al. ..... 340/568.1
6,816,974 B1 * 11/2004 Nurmi et al. ..... 726/16
6,867,685 B1 * 3/2005 Stillwagon ..... 340/5.64
7,021,091 B2 * 4/2006 Leyden et al. ..... 70/18
7,168,275 B2 * 1/2007 Fawcett et al. ..... 70/57
7,209,038 B1 * 4/2007 Deconinck et al. ..... 340/568.8
7,212,115 B1 * 5/2007 Fawcett ..... 340/546
7,446,659 B2 * 11/2008 Marsilio et al. ..... 340/568.1
2004/0150524 A1 8/2004 Bonato
2004/0229498 A1 * 11/2004 Fort et al. ..... 439/502

* cited by examiner

*Primary Examiner*—Eric M Blount
(74) *Attorney, Agent, or Firm*—Modiano & Associati; Albert Josif; Daniel J. O'Byrne

(57) ABSTRACT

An anti-theft device comprising a flexible cable provided with two conducting wires which are mutually connected in order to close an electrical contact and are connected, at a first end, to a control unit designed to act in response to the opening/closure of the electrical contact, characterized in that the flexible cable is connected, at the second end, to means for detachable connection to at least one item to be restrained, the detachable connection means comprising security means of the mechanical type which are adapted to prevent the opening of the detachable connection means, a deactivation device being provided which can engage the detachable connection means in order to open the security means.

15 Claims, 4 Drawing Sheets

ANTI-THEFT DEVICE, PARTICULARLY FOR DISPLAYS THAT CAN BE PLACED IN POINTS OF SALE

The present invention relates to an anti-theft device particularly but not exclusively adapted to be installed at displays that can be placed in the vicinity of points of sale.

BACKGROUND OF THE INVENTION

As is known, it is convenient to allow customers who enter a shop or shopping center to pick up, handle or try goods before purchase.

This often contrasts with the need to prevent ill-intentioned individuals from taking the goods from the shop or display space.

In order to try to obviate this drawback, anti-theft tags have already been proposed, but they can be used only in enclosed spaces or at least in spaces in which potential buyers are forced to pass, when they exit, through a device for detecting such tags.

It is evident that these devices, besides being often bulky, provide no assurance against theft in open-air exhibitions or if the displays are installed in halls or common areas within shopping centers.

In order to overcome this problem, WO 02/090693 A1 by the same Applicant relates to an anti-theft device constituted by at least one cable (which can be wound and unwound on and from a spool), which is associated, at its free end, with means for detachable engagement with an item to be restrained, said means being adapted to open and close an electrical contact, a control unit being provided which is designed to act in response to the opening/closure of the electrical contact.

It is evident that an anti-theft device of the type described above allows to fasten items to be restrained (such as for example eyeglasses) to displays in a practical and effective way.

However, these kinds of anti-theft devices, by having to use removable engagement means associated with means for opening/closing an electrical contact, have a production cost which makes them inconvenient to use in certain applications.

SUMMARY OF THE INVENTION

The aim of the present invention is to eliminate drastically the drawbacks encountered in traditional anti-theft devices while providing an anti-theft device that has a very simple structure.

Within this aim, an object of the invention is to provide an anti-theft device that has a competitive production cost, so that its use is advantageous also from the economical standpoint.

This aim and this and other objects, which will become better apparent hereinafter, are achieved by an anti-theft device comprising a flexible cable provided with two conducting wires which are mutually connected in order to close an electrical contact and are connected, at a first end, to a control unit designed to act in response to the opening/closure of said electrical contact, characterized in that said flexible cable is connected, at the second end, to means for detachable connection to at least one item to be restrained, said detachable connection means comprising security means of the mechanical type which are adapted to prevent the opening of said detachable connection means, a deactivation device being provided which can engage said detachable connection means in order to open said security means.

BRIEF DESCRIPTION OF THE DRAWINGS

Further characteristics and advantages of the invention will become better apparent from the description of some preferred but not exclusive embodiments of an anti-theft device according to the invention, illustrated by way of non-limiting example in the accompanying drawings, wherein.

Figure 1:
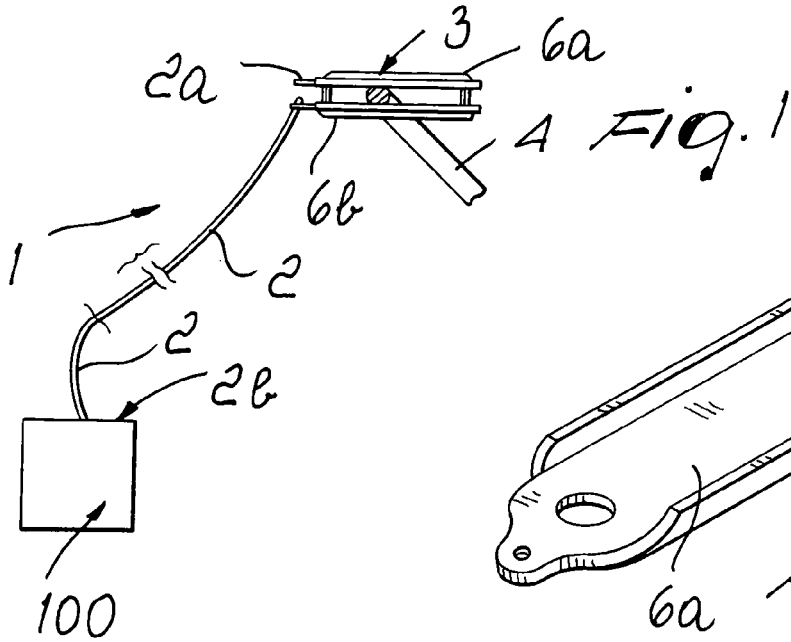
FIG. 1 is a sectional view of an item to be restrained, associated with an anti-theft device according to the present invention.
Figure 2:
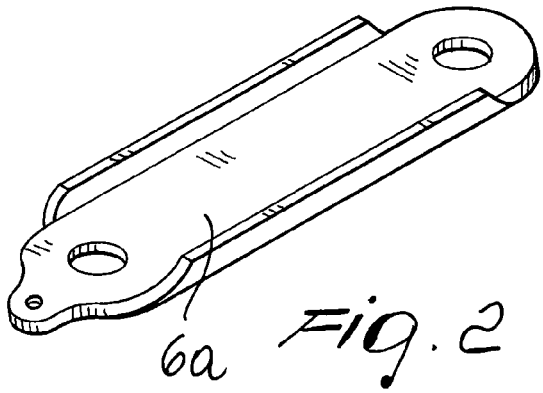
FIG. 2 is a perspective view of a first connecting plate, which constitutes the detachable connection means.
Figure 3:
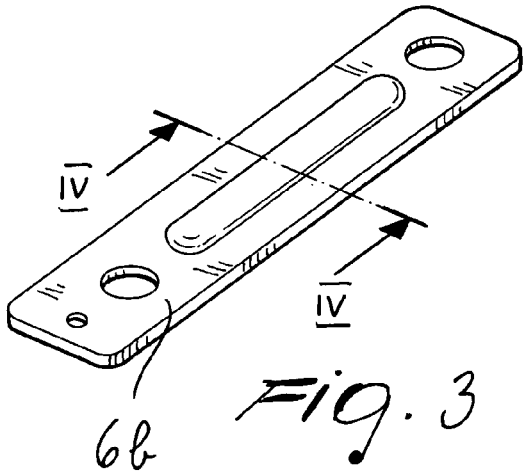
FIG. 3 is a perspective view of a second connecting plate, which cooperates with the first connecting plate in order to provide the detachable connection means.
Figure 4:
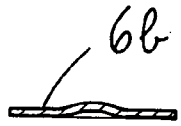
FIG. 4 is a sectional view of the second connecting plate, taken along the plane of arrangement traced by the line IV-IV of FIG. 3.
Figure 5:
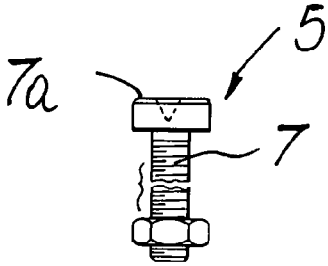
FIG. 5 is a side elevation view of an embodiment of the security means.
Figure 6:
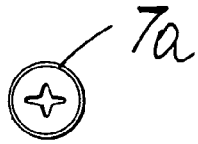
FIG. 6 is a top elevation view of the security means shown in FIG. 5.

In the embodiments that follow, individual characteristics, given in relation to specific examples, may actually be interchanged with other different characteristics that exist in other embodiments.

Moreover, it is noted that anything found to be already known during the patenting process is understood not to be claimed and to be the subject of a disclaimer.

DESCRIPTION OF THE PREFERRED EMBODIMENTS

With reference to the figures, an anti-theft device, generally designated by the reference numeral 1, comprises a flexible cable 2, which is provided with two conducting wires, which are mutually connected in order to close an electrical contact.

In particular, the cable 2 is connected, at a first end 2*b*, as shown in FIG. 1, to a control unit 100, which is designed to act in response to the opening/closure of the electrical contact if, for example, such cable is cut or torn; in particular, it is advantageous to provide the control unit so that it sends a signal (alarm) if the electrical contact between the two conducting wires is interrupted.

According to the present invention, the flexible cable 2 is connected, at the second end 2*a*, to means 3 for detachable connection to at least one respective item 4 to be restrained.

In greater detail, the detachable connection means 3 comprise security means 5 of a substantially mechanical type, which are adapted to prevent the opening of the detachable connection means 3.

In particular, the security means 5 are associated with a respective deactivation device 10, which can engage the detachable connection means 3 (or directly the security means 5) in order to allow (shop assistants) to open the security means 5, thus allowing to open the detachable connection means 3.

Advantageously, the two electrical wires (carried by the cable 2) are mutually connected at the second end 2*a* of the flexible cable.

According to a first embodiment, the detachable connection means 3 can be constituted by two plates 6*a* and 6*b*, which can be moved mutually closer/further apart in order to pass from an open condition to a closed condition in which they lock (as shown in FIG. 1) a portion of an item 4 to be restrained.

Conveniently, the security means 5 can be constituted by two screw elements 7, which can be associated with the detachable connection means 3 and are adapted to keep the detachable connection means in the closed condition so as to prevent the disengagement of the item 4 to be restrained. Conveniently, it is possible to associate the detachable connection means 3 with the item 4 to be restrained at an engagement region whose dimensions (for example in transverse cross-section) are smaller than those of the adjacent regions, so as to further prevent the possibility to slide off the detachable connection means 3.

In this case, the deactivation device 10 can be constituted by a screwdriver device 10*a*, which is provided with a tip 10*b*, which can engage an engagement head 7*a* formed on the screw elements 7; in this regard, it is advantageous to provide the engagement head 7*a* (and consequently the tip 10*b* of the screwdriver 10*a*) with a particular recess (for example with a three-pointed star) so as to make it even more difficult for ill-intentioned individuals to try to open the security means.

Figure 12:
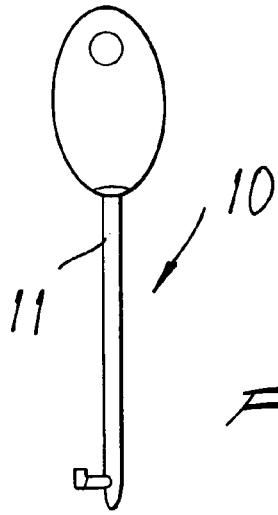
FIG. 12 is an elevation view of a second embodiment of a deactivation device.

According to another embodiment, the security means 5 can be constituted by a lock element, which can be activated for example by snap action in case of closure of the detachable connection means 3; in this case, the deactivation device comprises a key-like element 11 (shown in FIG. 12), which can engage the lock element in order to open the detachable connection means 3.

Figure 7:
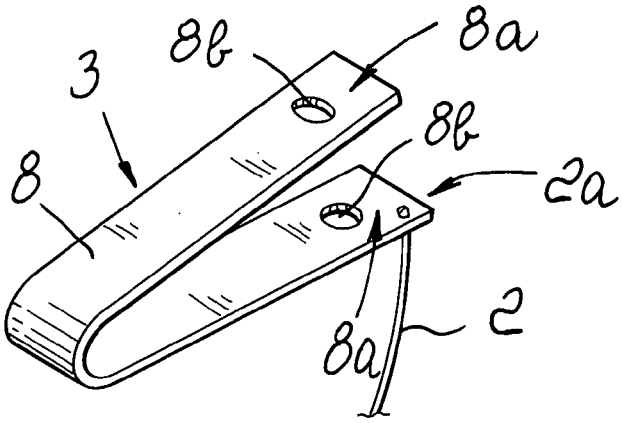
FIG. 7 is a perspective view of another example of embodiment of the detachable connection means.
Figure 8:
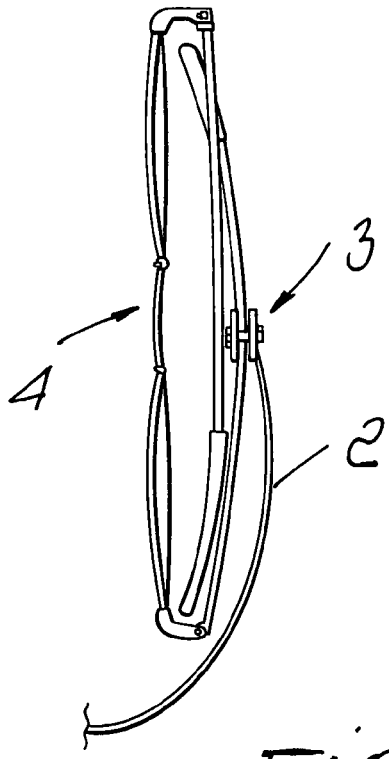
FIG. 8 is a top elevation view of a pair of eyeglasses associated with an anti-theft device according to the present invention.
Figure 9:
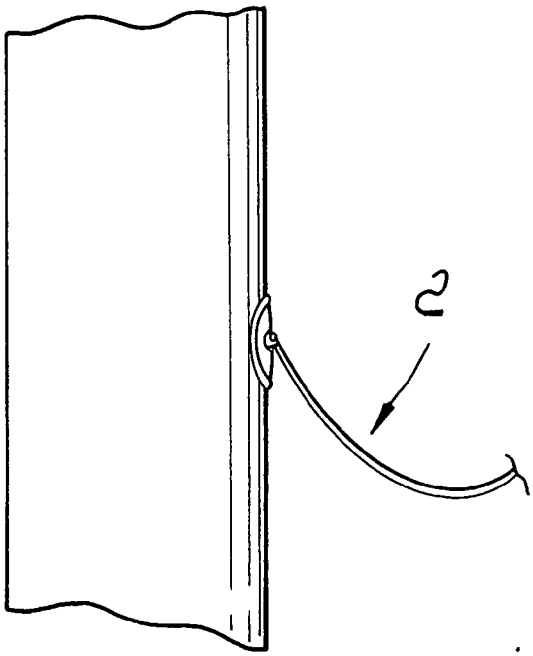
FIG. 9 is a view of a portion of a post of a display, with a portion of a cable of an anti-theft device associated therewith.

With reference now to the embodiment shown in FIG. 7, the detachable connection means 3 can be constituted by a folded lamina element 8, which is shaped like a clip and has, at its free end portions 8*a*, a respective engagement hole 8*b* for a screw element 7 of the type described above.

In this case also, the deactivation device 11 can be constituted by a screwdriver device 11*a*, which can engage the engagement head 7*a* formed on the screw element 7.

In this case, the screw element 7 can engage a fastening bolt or, as an alternative, can engage directly a female thread formed at one of the engagement holes 8*a*.

According to another embodiment, it is possible to replace the screw elements 7 with per se known press-on pins or rivets provided with an abutment head and with an end portion that can be expanded; in this case it is evident that the deactivation device is constituted by a pliers-like instrument, which is adapted for example to cut the end part so as to allow the disengagement thereof from the holes.

There is nothing to prevent the detachable connection means from being constituted by a vice-like element 30 (shown in FIG. 10) constituted by two plates 31*a* and 31*b*, which are mutually articulated by means of a longitudinal hinge 32. In the illustrated example, each one of the two plates 31*a* and 31*b* forms an engagement hole 8*a*, which is designed to accommodate a screw element 7 or, in a fully equivalent manner, a press-on pin.

According to another variation, the detachable connection means 3 can be constituted by an anchoring tie 20.

Figure 13:
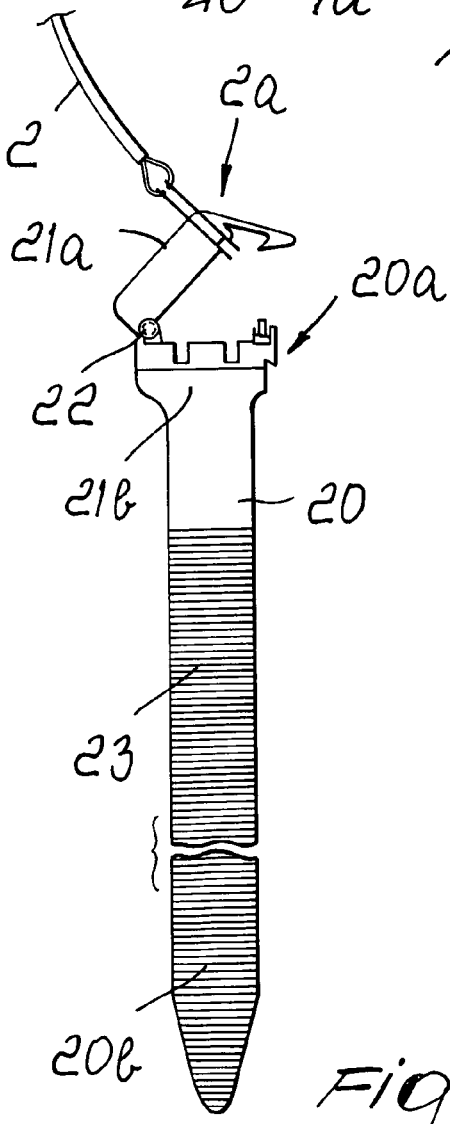
FIG. 13 is an elevation view of a variation of the detachable connection means.
Figure 14:
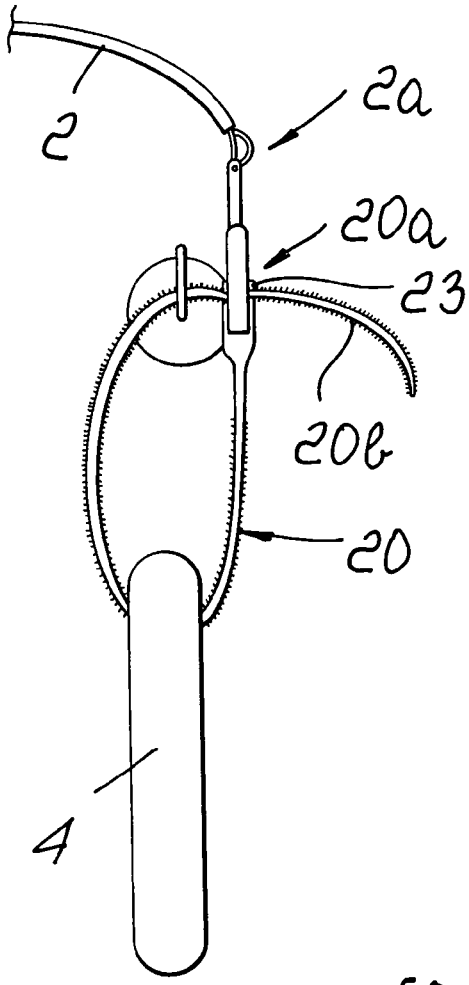
FIG. 14 is a view of the detachable connection means of FIG. 13 associated with an item to be restrained.

In particular, the anchoring tie 20 has a first end 20*a*, which is connected to the second end 2*a* of the cable 2; the first end 20*a* of the anchoring tie 20 has a rigid tip, which comprises a first connecting element 21*a* and a second connecting element 21*b*, which are mutually connected (for example by means of a hinge 22) in order to pass from an open condition (shown in FIG. 13) to a closed condition (shown in FIG. 14).

In the closed condition, the electrical contact between the two conducting wires is closed and at the same time the rigid tip forms an engagement opening 23 for the other free end 20*b* of the tie 20.

In this manner, by passing the other free end 20*b* of the tie 20 within the engagement opening 23, it is possible to obtain (by means of the tie 20) a restraining loop for any item to be restrained.

Conveniently, in order to prevent the extraction of the other free end 20*b* of the tie 20, such tie 20 is conveniently provided with extraction-preventing means, such as for example a knurling 23, which is adapted to allow sliding exclusively in the closing direction or rather in the direction in which the restraining loop becomes smaller.

Again with reference to the embodiment in which the detachable connection means 3 are constituted by a tie 20, such tie can also be constituted by a tie of the type used generally by electricians; in this case, it is convenient to provide, at the rigid tip, a portion of conductor for closing the electrical contact between the conducting wires if it is associated with the rigid tip (thus allowing to recycle the cable). In this case, the deactivation device is constituted by pliers or by a cutter adapted to cut the tie 20.

Advantageously, the cable 2 can be wound on, and unwound from, a respective spool at its first end; in particular, the spool is provided with elastic loading means in order to ensure the tensioning and automatic rewinding of the cable on the respective spool.

According to a preferred embodiment, the deactivation device 10 can be constituted by remote control means, for example a small remote control, which is capable of acting on the mechanical security means 5 accommodated within the detachable connection means 3.

Conveniently, the remote control can have an extremely limited radius range, so as to allow its action on the mechanical security means 5 only if it is, for example, placed against the detachable connection means 3.

Merely by way of example, the mechanical security means 5 can be associated with an inductance device, which can be activated by the remote control.

Advantageously, it is possible to use a remote control provided with an encoded code, so as to prevent a remote control used in one shop from being used to open mechanical security means 5 associated with an anti-theft device 1 of another shop.

Figure 15:
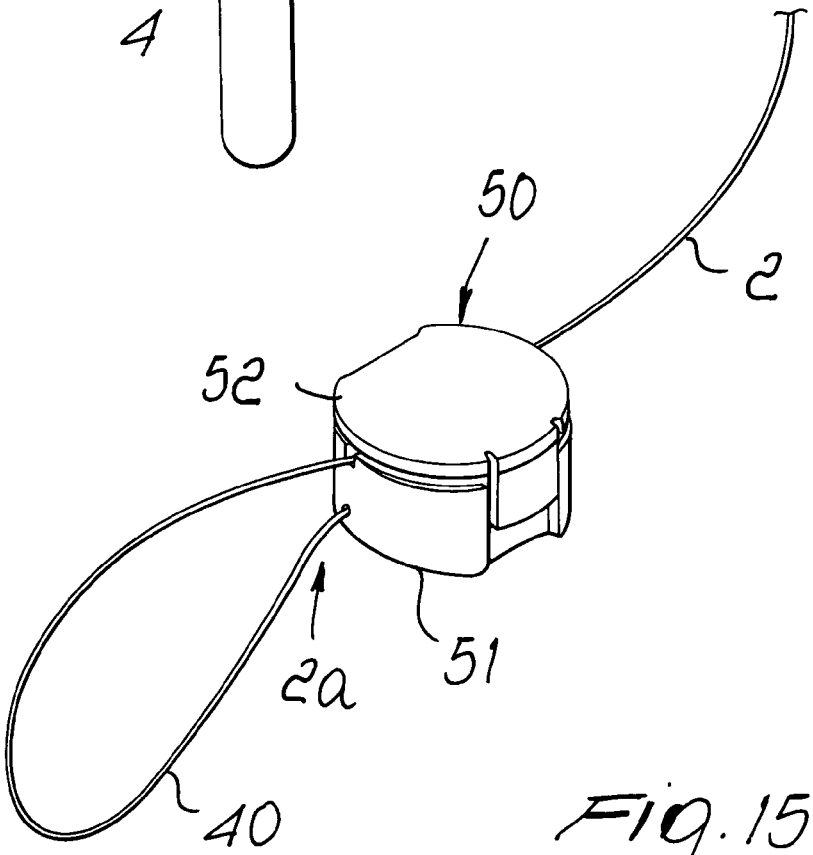
FIG. 15 is a perspective view of another embodiment of an anti-theft device according to the invention.

According to an important aspect of the present invention and with particular reference to the perspective view of FIG. 15, the detachable connection means 3 can be constituted by a fastening element 50, which is meant to lock a portion of the flexible cable 2 in order to form a restraining loop 40.

Advantageously, the fastening element 50 is constituted by a first jaw 51 and a second jaw 52, which are mutually articulated in order to pass from an engagement condition, in which the portion of the flexible cable 2 can move with respect to the first free end, and a restraining condition, in which the portion of the flexible cable 2 is in the locked position.

Conveniently, the free end 2*a* of the flexible cable 2 is connected to one of the two jaws (51, 52).

The first jaw 51 and the second jaw 52 are mutually articulated and are associated with the mechanical security means, which can be screws, locks or devices that can be controlled by remote control means such as the remote control described above.

According to another aspect, the present invention relates to an anti-theft device in which the flexible cable 2 is provided with two conducting wires, which are mutually connected in order to close an electrical contact and are connected, at a first end 2*b*, to a control unit 100, which is designed to act in response to the opening of said electrical contact.

At the second end 2*a* (or free end), the flexible cable 2 is connected to means 3 for detachable connection to at least one item to be restrained: said detachable connection means 3 are provided with mechanical security means 5. Moreover, when the detachable connection means 3 are closed, the electrical contact between the two conducting wires is also closed.

According to the present variation, by acting on a deactivation device 10 (which can be constituted advantageously by a remote control as described, moreover, in the previous example of embodiment), it can be possible to determine, by using mechanical or electrical control means, the retention of the electrical contact in the closed condition regardless of the opening of the detachable connection means 3 or (in equivalent manner) the deactivation of the control unit 100.

In practice, by acting on the remote control it is possible to force the closing of the electrical contact between the two conducting wires (in that the activation of contact bridges or similar devices prevents the interruption of the electrical contact as a consequence of the opening of the detachable connection means 3) or the control unit 100 is deactivated, consequently inhibiting the operation of the alarm device.

With reference to this variation, the mechanical security means 5 can be constituted simply by a closure tooth (on which it is optionally possible to act manually with ease in order to open and close it).

In fact, if an ill-intentioned individual tries to open the detachable connection means 3, when the detachable connection means 3 open (and if there has been no previous deactivation action performed by acting on the deactivation device 10), the electrical contact is opened and/or the control unit 100 is activated, causing the activation of the alarm.

When instead the operator must act on the anti-theft device 1 in order to disengage the item from the detachable connection means 3, first of all, with the aid of the remote control, the operator deactivates the control unit 100 or keeps the electrical contact in the closed condition and opens the detachable connection means only after performing this operation.

According to another aspect, the detachable connection means 3 can comprise a so-called adhesive tab (or a similar device), which is adapted to close the electrical contact between the two conducting wires when it is associated with the item to be restrained.

Operation of an anti-theft device according to the invention is as follows and is extremely simple and effective.

The assistant (or the manager of the shop or display space) restrains, by way of the detachable connection means, the items to be restrained to the flexible cable and activates the control unit.

At this point, the customer can comfortably grip the restrained item, examining it and/or trying it on.

If he decides not to purchase the product, he can put it back on the display, whereas if he wishes to purchase it the shop assistant, by using the deactivation means, opens the detachable connection means.

If the customer tries to steal the item, if he cuts or tears the cable, the alarm starts, while opening the detachable connection means is substantially prevented by the need to use the deactivation device (such as screwdrivers or keys), which would allow service staff to notice immediately the attempted theft.

All the characteristics of the invention described above as advantageous, convenient or the like may also be omitted or be replaced with equivalents.

The invention thus conceived is susceptible of numerous modifications and variations, all of which are within the scope of the appended claims.

Figure 10:
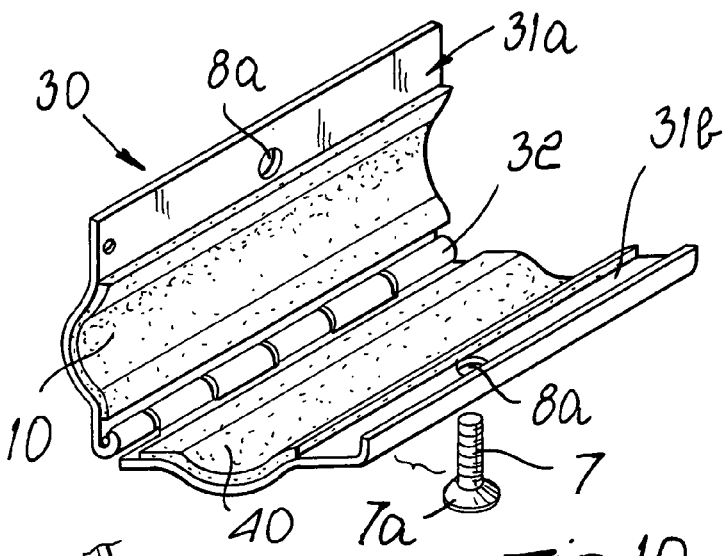
FIG. 10 is a perspective view of another embodiment of the detachable connection means.
Figure 11:
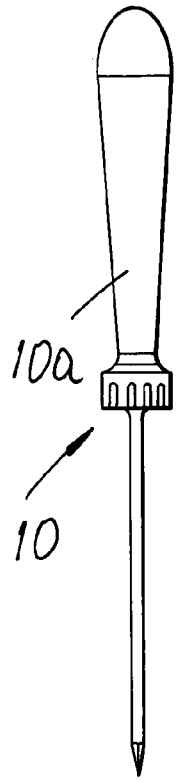
FIG. 11 is an elevation view of a first embodiment of a deactivation device.

Thus, for example, the detachable connection means 3 can be provided with protection portions 40 (made of sponge, rubber or similar materials) at the regions designed to lock the items to be restrained, as clearly shown in the embodiment of FIG. 10.

In practice it has been found that the invention has achieved the intended aim and object in all its embodiments.

In practice, the materials used, so long as they are compatible with the contingent use, as well as the dimensions (and the shapes), may be any according to requirements.

Moreover, all the details may be replaced with other technically equivalent elements.

Thus, for example, it is possible to replace the two conducting wires with a single two-pole conducting wire.

The disclosures in Italian Patent Application No. VR2004A000146 from which this application claims priority are incorporated herein by reference.

The invention claimed is:

1. An anti-theft device comprising a flexible cable provided with two conducting wires which are mutually connected in order to close an electrical contact and are connected, at a first end, to a control unit designed to act in response to the opening/closure of said electrical contact, wherein said flexible cable is connected, at the second end, to means for detachable connection to at least one item to be restrained, said detachable connection means comprising security means of the mechanical type which are adapted to prevent the opening of said detachable connection means, a deactivation device being provided which can engage said detachable connection means in order to open said security means, said deactivation device comprising remote-control means, which act on said mechanical security means associated with said detachable connection means.

2. An anti-theft device comprising a flexible cable provided with two conducting wires which are mutually connected in order to close an electrical contact and are connected, at a first end, to a control unit which is designed to act in response to the opening of said electrical contact, wherein said flexible cable is connected, at the second end, to means for detachable connection to at least one item to be restrained, said means being adapted to close said electrical contact and having security means of the mechanical type, said detachable connection means comprising two plates, which can be moved mutually closer/further apart in order to pass from an open condition to a closed condition in which they lock said item to be restrained.

3. An anti-theft device comprising a flexible cable provided with two conducting wires which are mutually connected in order to close an electrical contact and are connected, at a first end, to a control unit which is designed to act in response to the opening of said electrical contact, wherein said flexible cable is connected, at the second end, to means for detachable connection to at least one item to be restrained, said means being adapted to close said electrical contact and having security means of the mechanical type, the device further comprising a deactivation device, which acts on control means and is adapted to keep said electrical contact in the closed condition regardless of the opening of said detachable connection means.

4. The anti-theft device of claim 3, wherein said deactivation device is adapted to deactivate said control unit independently of the opening of said detachable connection means.

5. The anti-theft device of claim 3, wherein said security means of mechanical type comprise at least one closure tooth.

6. The anti-theft device of claim 1, wherein said remote-control means comprise a remote control.

7. The anti-theft device of claim 3, wherein said detachable connection means comprise a fastening element, which is adapted to lock a portion of said flexible cable in order to form a restraining loop.

8. An anti-theft device comprising a flexible cable provided with two conducting wires which are mutually connected in order to close an electrical contact and are connected, at a first end, to a control unit which is designed to act in response to the opening of said electrical contact, wherein said flexible cable is connected, at the second end, to means for detachable connection to at least one item to be restrained, said means being adapted to close said electrical contact and having security means of the mechanical type, said detachable connection means comprising a fastening element, which is adapted to lock a portion of said flexible cable in order to form a restraining loop, said fastening element comprising a first jaw and a second jaw, which are mutually articulated in order to pass from an engagement condition, in which a portion of the flexible cable can move with respect to the first free end, to a restraining condition, in which the portion of the flexible cable is in the locked position.

9. The anti-theft device of claim 3, wherein said detachable connection means comprise two plates, which can be moved mutually closer/further apart in order to pass from an open condition to a closed condition in which they lock said item to be restrained.

10. The anti-theft device of claim 3, wherein said security means comprise at least one screw element, which can be associated with said detachable connection means and is adapted to keep said detachable connection means in the closed condition, said deactivation device comprising a screwdriver device, which can engage an engagement head formed on said screw element.

11. The anti-theft device of claim 1, wherein said security means comprise a lock element, said deactivation device comprising a key element, which can engage said lock element in order to open said detachable connection means.

12. The anti-theft device of claim 11, wherein said detachable connection means comprise a folded lamina element, which is shaped like a clip and has, at its free end portions, a respective engagement hole for a screw element, said deactivation device comprising a screwdriver device which can engage an engagement head formed on said screw element.

13. The anti-theft device of claim 1, wherein said security means comprise a rivet and said deactivation device comprises pliers.

14. The anti-theft device of claim 1, wherein said detachable connection means comprise an anchoring tie, which has a first end connected to said second end of said cable and comprises a rigid tip, which has a first connecting element and a second connecting element, which are mutually connected in order to pass from an open condition to a closed condition, and close, in said closed condition, the electrical contact between said two conducting wires and form an engagement opening for the other free end of said tie, said tie having extraction-preventing means.

15. The anti-theft device of claim 1, wherein said cable can be wound on, and unwound from, a respective spool at said first end, said respective spool being provided with elastic loading means in order to ensure the automatic tensioning and rewinding of said cable on the respective spool.

* * * * *